US012584672B2

(12) United States Patent
Cartellone et al.

(10) Patent No.: US 12,584,672 B2
(45) Date of Patent: Mar. 24, 2026

(54) APPLIANCE FOR MAKING AND COLLECTING ICE HAVING VARIED CHARACTERISTICS

(71) Applicant: Rockhopper Ice Collective Inc., Delaware, OH (US)

(72) Inventors: Josh Cartellone, Delaware, OH (US); Daniel Guenther, Pewaukee, WI (US); Emily Cartellone, Delaware, OH (US)

( * ) Notice: Subject to any disclaimer, the term of this patent is extended or adjusted under 35 U.S.C. 154(b) by 117 days.

(21) Appl. No.: 18/792,933

(22) Filed: Aug. 2, 2024

(65) Prior Publication Data

US 2025/0044011 A1 Feb. 6, 2025

Related U.S. Application Data

(60) Provisional application No. 63/517,135, filed on Aug. 2, 2023.

(51) Int. Cl.
*F25C 1/22* (2018.01)

(52) U.S. Cl.
CPC ..... *F25C 1/22* (2013.01); *F25C 2600/04* (2013.01)

(58) Field of Classification Search
CPC ..... F25C 1/22; F25C 2600/04
See application file for complete search history.

(56) References Cited

U.S. PATENT DOCUMENTS 3,662,564 A 5/1972 Clearman et al.
4,198,831 A 4/1980 Barnard et al.
4,959,966 A 10/1990 Dimijian
5,924,301 A 7/1999 Cook
2002/0078705 A1* 6/2002 Schlosser ..... F25D 23/006 62/340

(Continued)

FOREIGN PATENT DOCUMENTS

CN 2248854 Y 3/1997
CN 202254599 U 5/2012

(Continued)

OTHER PUBLICATIONS

DUMOS Countertop Ice Maker, Portable Ice Machine Self-Cleaning, 9 Cubes in 6 Mins, 26.5lbs/24Hrs, 2 Sizes of Bullet Ice, with Ice Scoop, Basket and Handle, Ice Cube Maker for Home Kitchen Party, Green. Amazon.com. https://www.amazon.com/DUMOS-Countertop-Portable-Machine-Self-Cleaning/dp/B0CQKYK19F?th=1. Retrieved Aug. 2, 2024.

(Continued)

*Primary Examiner* — Nael N Babaa
(74) *Attorney, Agent, or Firm* — Carlson, Caspers, Vandenburgh & Lindquist, P.A.

(57) ABSTRACT

Embodiments described herein provide for an apparatus for making ice. The apparatus includes a refrigeration system configured to provide chilled coolant to two or more evaporators. The two or more evaporators are configured to produce ice having a first set of characteristics and to produce ice having a second set of characteristics. The characteristics of the first set of characteristics and the characteristics of the second set of characteristics consist of geometry, volume, compressive strength, and clarity. At least one characteristic of the second set of characteristics is different in value than the corresponding characteristic in the first set of characteristics.

20 Claims, 14 Drawing Sheets

(56) References Cited

U.S. PATENT DOCUMENTS

| | | | |
|---|---|---|---|
| 2011/0094252 | A1 | 4/2011 | Yamaguchi et al. |
| 2017/0082338 | A1 | 3/2017 | Wobrock et al. |
| 2024/0053078 | A1 | 2/2024 | Lee et al. |

FOREIGN PATENT DOCUMENTS

| | | | |
|---|---|---|---|
| CN | 204574655 | U | 8/2015 |
| CN | 104930777 | A | 9/2015 |
| CN | 209819950 | U | 12/2019 |
| CN | 111043804 | A | 4/2020 |
| CN | 112648766 | A | 4/2021 |
| CN | 215412643 | U | 1/2022 |
| CN | 115289735 | A | 11/2022 |
| CN | 217929317 | U | 11/2022 |
| CN | 116772473 | A | 9/2023 |
| CN | 220911744 | U | 5/2024 |
| CN | 221076823 | U | 6/2024 |
| GB | 787876 | A | 12/1957 |
| JP | 2005351624 | A | 12/2005 |
| WO | 2012091484 | A2 | 7/2012 |

OTHER PUBLICATIONS

Iceman Dual-Size Ice Machine, Portable Ice Maker Machine, Creates 2 Cube Sizes in 6 Mins, Holds 1.3 lb. of Ice. homedepot.com. https://www.homedepot.com/p/ICEMAN-Dual-Size-Ice-Machine-Portable-Ice-Maker-Machine- Creates-2-Cube-Sizes-in-6-Mins-Holds-1-3-lb-of-Ice-RJ56-D-1/323858310. Retrieved Aug. 2, 2024.

r/cocktails [atvinus]. Any ice makers out there that can do multiple shapes of ice? reddit.com. https://www.reddit.com/r/ cocktails/comments/17t6goa/any_ice_makers_out_there_that_can_do_multiple/?rdt=61038. Retrieved Aug. 2, 2024.

Skyra Clear Ice Maker. vestaprecision.com. https://www.vestaprecision.com/products/skyra-clear-ice-maker. Retrieved Aug. 2, 2024.

* cited by examiner

APPLIANCE FOR MAKING AND COLLECTING ICE HAVING VARIED CHARACTERISTICS

RELATED APPLICATIONS

This application claims the benefit of U.S. Provisional Application No. 63/517,135, filed on Aug. 2, 2023, and entitled "System for Making, Forming, Storing, and Dispensing Ice", which is hereby incorporated herein by reference.

BACKGROUND

Consumers add ice to beverages for multiple purposes, which include inter alia, cooling the beverage and aesthetically improving the consumer experience. Ice is often made of water but may be made from other substances to better suit different beverages, such as forming ice from a fruit juice to add flavor to a beverage as the ice melts. Ice is often procured for beverages by means of an ice machine or an ice delivery service. Ice machines typically make and store ice of a single type for convenient use. These types include cubed ice, crescent ice, nugget ice, flake ice and others. Sometimes certain types of ice are modified, such as crescent ice being crushed by a common household refrigerator.

SUMMARY

Embodiments described herein provide for an apparatus for making ice. The apparatus includes a refrigeration system configured to provide chilled coolant to two or more evaporators. The two or more evaporators are configured to produce ice having a first set of characteristics and to produce ice having a second set of characteristics. The characteristics of the first set of characteristics and the characteristics of the second set of characteristics consist of geometry, volume, compressive strength, and clarity. At least one characteristic of the second set of characteristics is different in value than the corresponding characteristic in the first set of characteristics.

Embodiments described herein also provide for another apparatus for making ice that includes a waterfall evaporator. The waterfall evaporator includes a water outlet for liquid water and a plurality of wells disposed such that liquid water flows from the water outlet across the plurality of wells. The waterfall evaporator also includes a cooling line configured to remove heat from the plurality of wells. The waterfall evaporator also includes a plurality of molds for forming ice of a defined geometry. Each of the plurality of molds includes a first mold portion and a second mold portion which, when assembled, form a chamber having the defined geometry. The first mold portion of each of the plurality of molds is disposed in a respective well of the plurality of wells. The second mold portion of each of the plurality of molds opposes the first mold portion. The second mold portion of each of the plurality of molds is configured to move relative to the first mold portion such that the plurality of molds have an open position and a closed position. In the open position water can flow over the plurality of wells and freeze into a geometry defined by the first mold portion. In the closed position, ice formed on the first mold portion is pressed by the second mold portion to form ice of the defined geometry.

Embodiments described herein also provide for an apparatus for making ice that includes an auger evaporator. The auger evaporator includes a housing configured to hold water. The housing has one or more apertures on a first end thereof. A cooling line is disposed around the housing to remove heat from the housing. An auger is disposed in the housing. A motor is configured to rotate the auger relative to the housing. The auger, when rotated by the motor, moves water toward the first end of the housing. The water freezes as it moves towards the first end and is extruded out of the one or more apertures in the first end. A cutter is disposed on the first end of the housing and configured to move across the one or more apertures to cut off ice extruded through the one or more apertures to form discrete pieces of ice. A motor is configured to move the cutter across the one or more apertures. A controller is configured to control the auger evaporator to make first ice during a first time period and to make second ice during a second time period. The second ice is different in at least one characteristic from the first ice.

DESCRIPTION

Establishments with a need or desire to have multiple types of ice must procure and have space for multiple ice machines. Embodiments described herein provide a single appliance that is capable of making multiple types of ice. Thus, an establishment can procure and install a single appliance and obtain multiple types of ice. The appliance can also be capable of organizing the ice made into separate bins such that a user can obtain ice having first characteristics from a first bin and ice having second characteristics from a second bin. Some embodiments disclosed herein allow for user selection of characteristics of the ice created.

The discussion herein may be made with reference to a commercial food service environment, but it should be understood that users may utilize the appliances disclosed herein in any type of food service, hospitality, healthcare, industrial or other suitable environment, including residential environments. Exemplary food service environments in which a user may implement the appliance include bars, restaurants, cafeterias, office buildings, schools, commercial buildings, and other food service locations.

Figure 1:
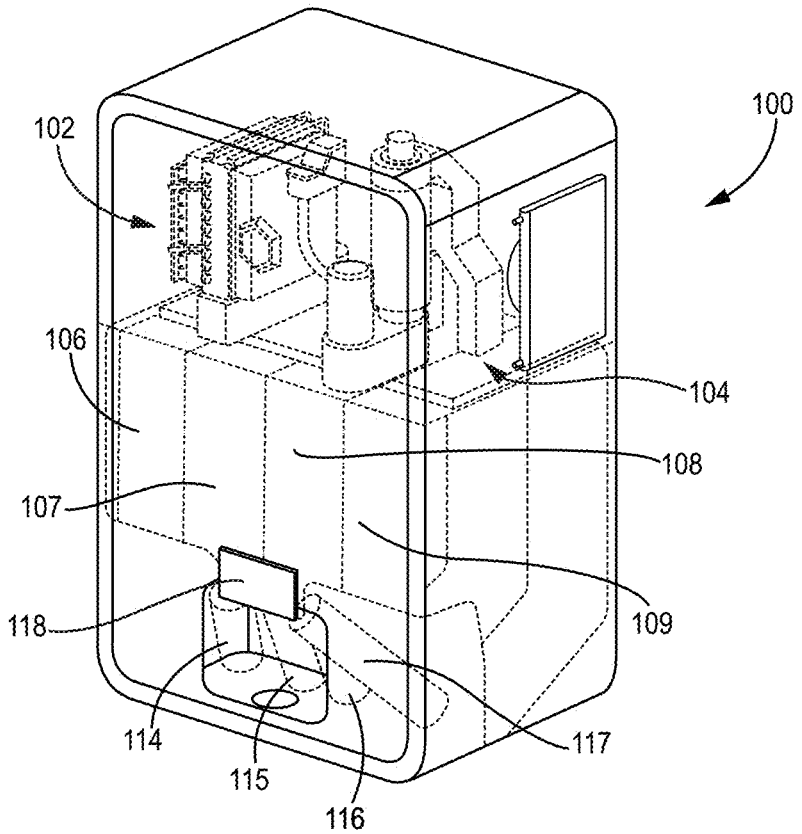
FIG. 1 is a perspective view of the components of an example appliance for making and collecting ice of varied characteristics.

FIG. 1 is a perspective view of the components of an example appliance 100 for making and collecting ice of varied characteristics. The appliance 100 can include multiple evaporator modules 102, 104 within a single housing. Each evaporator module 102, 104 can be configured to make ice having different characteristics from the other evaporator modules 102, 104. The appliance 100 creates multiple collections of ice pieces, each collection of ice pieces including a plurality of ice pieces, wherein each ice piece in a collection has a common set of characteristics.

The first module 102 is configured to make ice of a first type, that is, the first module 102 is configured to make a first collection of ice pieces having a first common set of characteristics. The second module 104 is configured to make ice of a second type, that is, the second module 104 is configured to make a second collection of ice pieces having a second common set of characteristics. The set of characteristics used in the first set of characteristics and the second set of characteristics consists of the geometry of the ice, the volume of the ice, the compressive strength of the ice, and the clarity of the ice. The second set of characteristics differs from the first set of characteristics in that at least one characteristic in the second set of characteristics differs in value from the corresponding at least one characteristic in the first set of characteristics. This variation in the value of one or more characteristics corresponds to a different type of ice.

Ice formed by any evaporator module will have some natural variation in values of the set of characteristics. Such natural variation is all included within a single type of ice. For example, hard cube ice produced by an evaporator module will have pieces of ice that are not perfect cubes. All the ice produced by an evaporator module configured to produce ice having a generally cube geometry, however, is considered herein to be a single type of ice. Ice of a different type refers to the module being set up to produce ice having noticeably different characteristics than another module. For example, two identical modules set up in the same way will produce ice having a common set of characteristics. Even though there will be some variation within the pieces of ice created by the two identical modules, the collection of ice from each module will, overall, have the same set of characteristics. Thus, both identical modules would be considered to produce the same type of ice. The first module 102 and second module 104 of appliance 100 described herein are configured to produce different types of ice. As described above, the first module 102 is configured to produce ice having a first set of characteristics and the second module 104 is configured to produce ice having a second set of characteristics, wherein at least one characteristic is different in value than the first set of characteristics. This difference in value of at least one characteristic can be obtained by having a different structure for the second module 104 as compared to the first module 102 (e.g., a waterfall evaporator vs. an auger evaporator) or can be obtained by having a common structure with different settings (e.g., two auger evaporators having different control settings).

As used herein, a difference in value for the volume, compressive strength, and clarity characteristics is a change of at least 10% or at least 20% in the value. The change in each value need not be the same. For example, a first type of ice can have three of the four characteristics the same as a second type of ice, but the compressive strength of the second type of ice can be 10% higher than the compressive strength of the first type of ice. A difference in value for the geometry characteristic is a significantly different geometry (e.g., cube vs. sphere vs. top hat vs. crescent, etc.). In an example, the difference in value of at least one characteristic is a difference in compressive strength of the ice, wherein the difference in compressive strength of a suitable sample of a first collection of ice is at least twenty percent greater than the compressive strength of a suitable sample of a second collection of ice. For example, chewable ice has a lower compressive strength than non-chewable (hard) ice.

Examples of different types of ice known in the industry today include hard (non-chewable) ice having various geometries such as cubed, crescent, top hat, or craft/premium/gourmet ices such as spheres or Collins ice and soft (chewable) ice such as nugget or flake. More detail on evaporator modules for creating different types of ice is provided below.

In the example shown in FIG. 1, the appliance 100 includes two evaporator modules 102, 104, however, one or more than two evaporator modules can be included. The first evaporator module 102 in the appliance 100 is configured to make ice having one or more first characteristics. The second evaporator module 104 in the appliance 100 is configured to make ice having one or more second characteristics. Any suitable evaporator module can be used in the appliance 100 including, but not limited to, plate (vertical, horizontal, or slated), waterfall (also referred to as flow-down), auger, drum or barrel, or circulation.

The appliance 100 include multiple bins 106-109 for collecting ice created by the evaporator modules 102, 104. The appliance can be configured to direct ice having different characteristics into respective bins 106-109 such that each bin collects ice having a common set of characteristics, and ice with different characteristics is directed to different bins. In the example shown in FIG. 1, the appliance 100 includes four bins 106-109 and, therefore, is capable of collecting four different forms of ice. In other examples, two, three, or more than four bins can be used. Although FIG. 1 illustrates a particular physical location and size of each evaporator module 102, 104 and bin 106-109, other locations and sizes can be used.

The appliance 100 can be configured to receive suitable electrical power (e.g., 220 or 110 volt AC line power) to power the electrical components of the appliance. The appliance can also include a power supply that converts the power received by the appliance (e.g., the line power) to power suitable for the components of the system, including the components of the refrigeration system 600. In an example, all components of the refrigeration system 600 receive power from a common plug of the appliance 100. The appliance 100 can also be configured to receive water or other suitable liquid such as water with additives for freezing into ice, such as via a connection to a common pressurized water supply.

Figure 2:
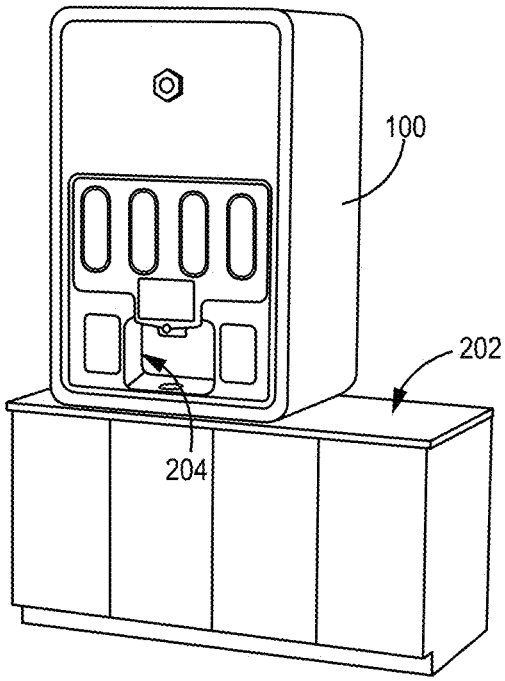
FIG. 2 is perspective view of the appliance of FIG. 1 on a counter.

FIG. 2 is perspective view of the appliance 100 on a counter 202. The appliance 100 is configured to allow a user to obtain ice from the bins 106-109. In the example shown in FIG. 1, the appliance 100 includes a dispensing chute from which ice from the bins 106-109 is dispensed into a container separate from the appliance 100. A user can place a container into which ice is to be received into a recess 204 formed in the appliance 100. The dispensing chute can be disposed above the recess 204 such that ice directed out of the dispensing chute falls into a container placed in the recess 204. In an example, ice from all of the bins 106-109 can be dispensed from the dispensing chute, such that a user can receive multiple different forms of ice from the same dispensing chute.

The appliance 100 can include a human machine interface 118 configured to receive a selection of which form of ice to dispense. Any suitable human machine interface (HMI) can be used including physical buttons, touch-sensitive buttons, touch screens, and/or other interfaces. The HMI can be configured to receive the selection of form of ice to dispense in any suitable manner, such as a selection of a particular type of ice (e.g., cubed, nugget, flake) or a particular bin to dispense from (e.g., bin 106, bin 107, bin 108, etc.).

The appliance 100 can include a controller communicatively coupled to the HMI and configured to receive signals from the HMI indicative of a selection of ice to dispense from a user. In response to receiving a signal indicative of a selection of ice to dispense, the controller can dispense ice from the bin 106-109 corresponding to the selection of ice.

Referring back to FIG. 1, the appliance 100 can include an auger system for feeding ice from the bins 106-109 to the dispensing chute. The auger system includes multiple augers 114-117 configured to move ice from a bottom portion of each bin 106-109 to the dispensing chute. In other examples, other means can be used to direct ice from each bin 106-109 to the dispensing chute, such as disposing the bins 106-109 higher than the dispensing chute and including flaps to block or allow ice from each bin to fall to the dispensing chute.

Figure 3:
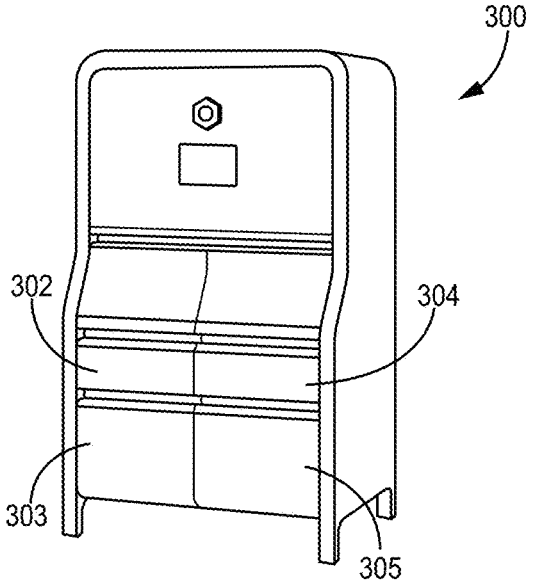
FIG. 3 is a perspective view of another example appliance for making and collecting ice of varied characteristics that is free-standing.
Figure 4:
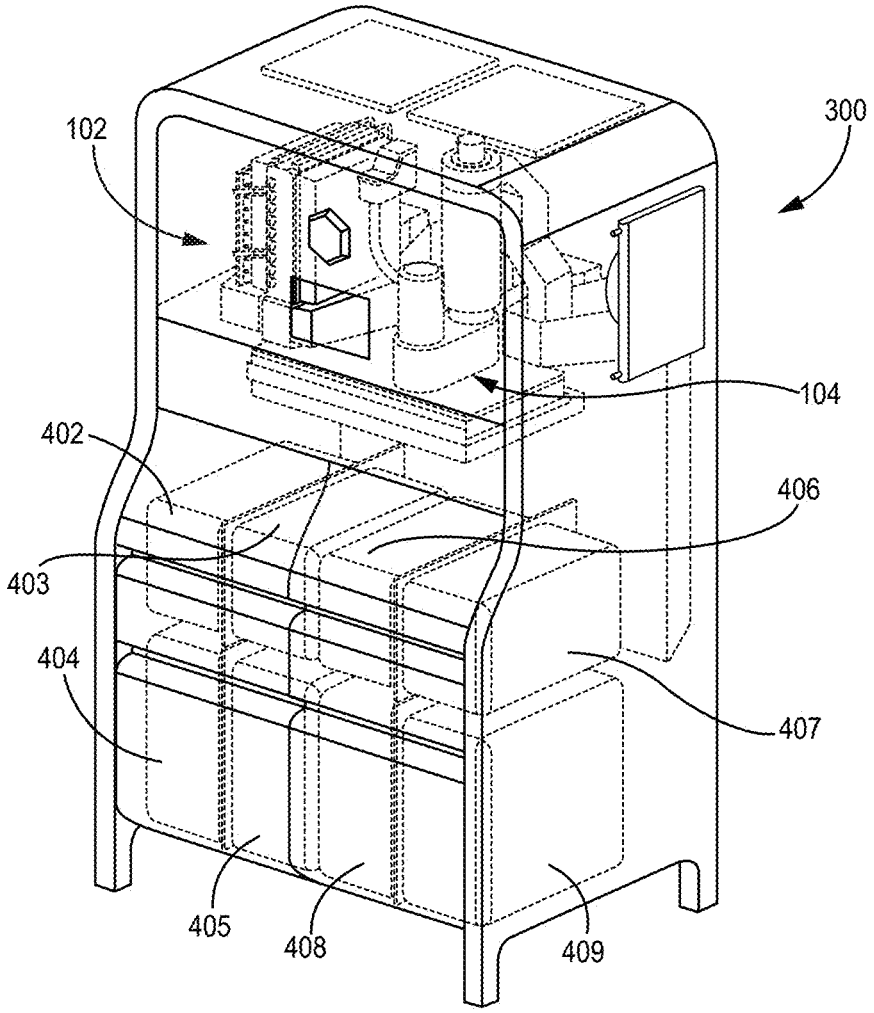
FIG. 4 is a perspective view of the components of appliance of FIG. 3, showing bins in the drawers.
Figure 5:
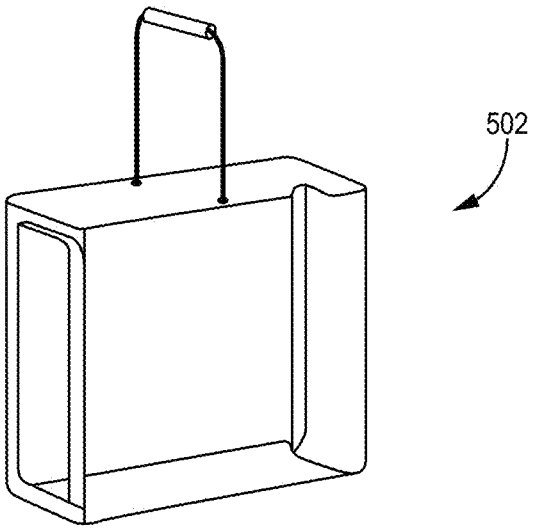
FIG. 5 is a perspective view of an example removable bin from the appliance of FIG. 3.

FIG. 3 is a perspective view of another example appliance 300 that is free-standing and includes a plurality of drawers 302-305 allowing users to access bins of ice by opening of the drawings 302-305. FIG. 4 is a cross-sectional view of the components of the appliance 300 showing bins 402-409 in the drawers 302-305. In the example appliance 300 shown in FIGS. 3 and 4, a user can open a drawer 302-305 and scoop out ice from a desired bin 402-409. In some examples, the bins 402-409 can be removable from the drawers 302-305 enabling ice to be carried in the bins 402-409 to a desired location and also enabling easier cleaning of the bins 402-409. FIG. 5 is a perspective view of an example removable bin 502 from the appliance 300. Appliance 300 can be similar to appliance 100 except as described above with respect to the drawers 302-305 and bins 402-409.

Figure 6:
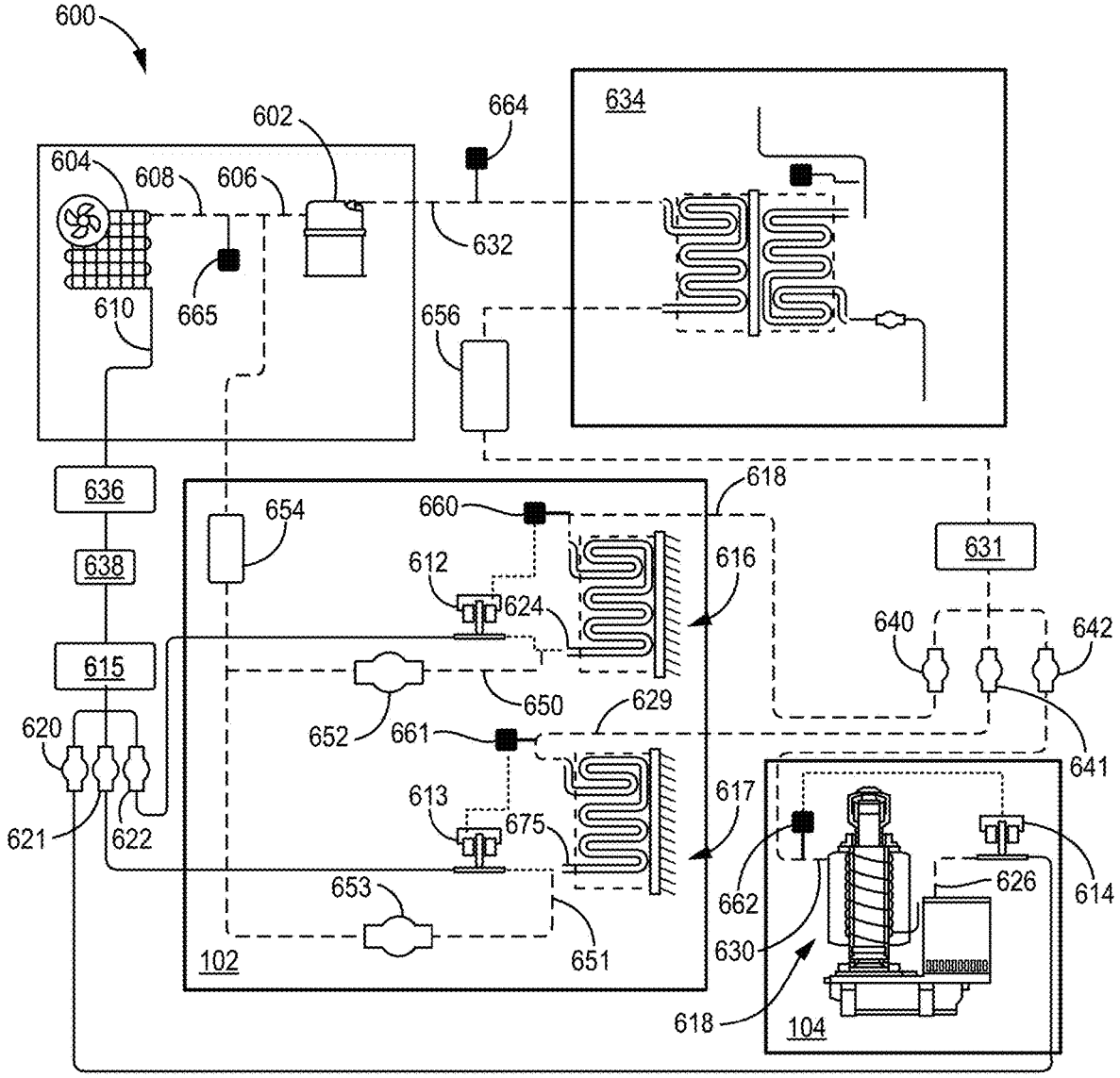
FIG. 6 is a block diagram of an example refrigeration system for the ice making appliance of FIGS. 1 and 3.

FIG. 6 is an example refrigeration system 600 for an ice making appliance 100, 300 disclosed herein. The refrigeration system 600 provides cooling for the evaporator modules 102, 104 enabling the evaporator modules 102, 104 to turn a liquid, such as water or water with additives, into ice. In this example, all the evaporator modules 102, 104 are part of a common refrigeration system 600. Thus, the cooling fluid for all of the evaporator modules 102, 104 flows through a common set of compressors 602 and condensers 604. The set of compressors 602 can include one or more compressors plumbed in parallel with one another. Any suitable compressor(s) can be used. The output from each of the compressors can be combined to form a single high pressure output 606 for the set of compressors 602. The high pressure output 606 can be fluidly coupled to a high temperature input 608 of the one or more condensers 604. If multiple condensers 604 are used, the multiple condensers 604 can be disposed in parallel with one another, with each fluidly coupled to and receiving high pressure refrigerant from the high pressure output 606 of the set of compressors 602. Any suitable condenser(s) 604 can be used including an air cooled condenser having a fan. The condenser(s) 604 are configured to remove heat from the refrigerant and provide cooled high pressure refrigerant to a common low temperature output 610.

The low temperature output 610 from the condenser(s) 604 can be fluidly coupled to one or more expansion valves 612-614. In the example shown in FIG. 6, there is an expansion valve 612-614 for each evaporator in the appliance 100, 300. The first evaporator module 102 includes two evaporators 616, 617 and the second evaporator module 104 includes one evaporator 618. Thus, the refrigeration system 600 includes a first expansion valve 612 fluidly coupled between the low temperature output 610 of the condenser(s) 604 and a first evaporator 616 of the first evaporator module 102, a second expansion valve 613 fluidly coupled between the low temperature output 610 of the condenser(s) 604 and a second evaporator 617 of the first evaporator module 102, and a third expansion valve 614 fluidly coupled between the low temperature output 610 of the condenser(s) 604 and the third evaporator 618 of the second evaporator module 104. Each evaporator 616-618 is a heat exchanger configured such that as the refrigerant flows through the evaporator 616-618, at least a portion of the refrigerant evaporates (changes from liquid to gas) within a cooling line and removes heat from the surrounding environment, e.g., water, that is thermally coupled to the cooling line as it evaporates. Each evaporator 616-618 includes its own cooling line through which the refrigerant circulating through the refrigeration system 600 flows, such that each evaporator 616-618 provides its own line that evaporates refrigerant. Each evaporator 616-618 also has its own expansion valve 612-614 to facilitate the evaporation of refrigerant.

A warm refrigerant line 650, 651 can also be coupled to the cooling line of the waterfall evaporators 616, 617. The warm refrigerant line 650, 651 can be used to release ice formed in the waterfall evaporators 616, 617. The warm water lines 650, 651 can be coupled to the refrigeration system between the compressor 602 and the condenser 604 to provide warm refrigerant to the input of the cooling lines of the waterfall evaporators 616, 617. The warm refrigerant lines can include an appropriate solenoid 652, 653 for controlling flow of warm refrigerant to the waterfall evaporators 616, 617. A strainer 654 can also be included in the warm refrigerant lines.

Other suitable components can be fluidly coupled between the low temperature output 610 of the condenser(s) 604 and the expansion valves 612-614 such as a receiver 636, dryer 638, and a manifold 615 to split the water into multiple lines, one line for each evaporator. Each evaporator 616-618 can also include a respective solenoid 620-622 fluidly coupled in front of the respective expansion valve 612-614 for the evaporator 616-618. The solenoids 620-622 can be communicatively coupled to a controller which can control the solenoids to control the flow of refrigerant to each evaporator 616-618 individually. That is, the controller can independently turn on and off the flow of refrigerant to each evaporator 616-618 by controlling the solenoids 620-622. Each expansion valve 612-614 maintains high pressure refrigerant on one side thereof while allowing refrigerant to pass therethrough into a low pressure line. As such, each expansion valve 612-614 can have a high pressure input and a low pressure output. Any suitable expansion valve can be used.

As discussed above, each evaporator 616-618 is configured to remove heat from water in the respective evaporator module 102, 104 by transferring heat from the water to the refrigerant. As such, each evaporator 616-618 has a low temperature input 624-626 and high temperature output 628-630. Each low temperature input 624-626 is fluidly coupled to the low pressure output of a respective expansion valve 612-614. The high temperature output 628-630 of each evaporator 616-618 can be fluidly coupled together via a manifold 631, such that the refrigerant from each evaporator 616-618 is combined into a single line. This single line can be coupled to the common low pressure input 632 for the set of compressors 602. The refrigerant in this common low pressure input 632 can be split to multiple compressors fluidly coupled in parallel in the set of compressors 602. The set of compressors 602 compresses the low pressure refrigerant to a high pressure and outputs the refrigerant from the common high pressure output 604 to start the cycle over again.

Other suitable components can be included in the system 100. For example, check valves 640-642 can be disposed downstream of the outlet of each evaporator 616-618 to prevent refrigerant from flowing into an evaporator 616-618 in the wrong direction. A heat exchanger 634 can be disposed between the evaporator modules 102, 104 and the set of compressors 602 to chill the input water to the appliance 100, 300 prior to the water flowing to the evaporator modules 102, 104. This heat exchanger 634 can flow refrigerant through one side and the water input to the appliance 100, 300 through the other side such that heat is removed from the input water by the refrigerant. This can be used to provide input water to the evaporators 102, 104 at a deterministic low temperature. An accumulator 656 can also be fluidly coupled to the system upstream of such a heat exchanger 634.

A plurality of temperature sensors 660-662 (e.g., at least one for each evaporator 616-618) can be included in the system 600 and communicatively coupled to the controller to provide indications of a temperature of each evaporator 616-618. In this example, the temperature sensors 660-662 are configured to sense a temperature of the coolant proximate the high temperature output 628-630 of each evaporator 616-618. The controller can control operation of the system 600, such as operation of the solenoids 620-622, based on signals from the temperature sensors 660-662 to maintain the respective evaporators 616-618 at a desired low temperature to make ice when desired.

A plurality of pressure sensors 664, 665 can also be included to provide indications of the pressure of the refrigerant at various locations within the system 100. In this example, a first pressure sensor 664 is disposed proximate the low pressure input of the compressor(s) 602 and a second pressure sensor 665 is disposed proximate the high pressure output of the compressor(s) 602. The pressure sensors 664, 665 can be communicatively coupled to the controller, which can be configured to control operation of the system 100 based on signals received therefrom. For example, the controller can be configured to control operation of the compressor(s) 602 to maintain a desired pressure differential between the first pressure sensor 664 and the second pressure sensor 665 when refrigerant is being flowed through one or more of the evaporators 616-618 to make ice therein.

By incorporating all the evaporator modules 102, 104 within a single refrigeration system 600 efficiencies can be gained. For example, a single set of compressors 602 and condenser(s) 604 can be shared by the multiple evaporator modules 102, 104 and the system 100 can be controlled together. Although two evaporator modules 102, 104 including three evaporators 616-618 are shown in FIG. 6, these numbers are only exemplary. Each evaporator/evaporator module can be coupled in parallel with the other evaporators/evaporator modules.

FIGS. 7A-7D are perspective views of an example modular component which can be installed and/or removed from an appliance 100, 300. The modular component includes an upper box 704 which can house the refrigeration system 600 including the waterfall evaporator module 102 and the auger evaporator module 104 as shown in FIGS. 1 and 3. A horizontal evaporator module 702 can be disposed beneath the waterfall evaporator module 102 and the auger evaporator module 702 and can be coupled to the refrigeration system 600 in parallel with the waterfall evaporator module 102 and the auger evaporator module 104. The horizontal module 702 would include similar supporting components as the waterfall evaporator module 102 and auger evaporator module 104 discussed with respect to FIG. 6, such as an expansion valve, refrigerant solenoid, and warm refrigerant solenoid.

Figure 7A:
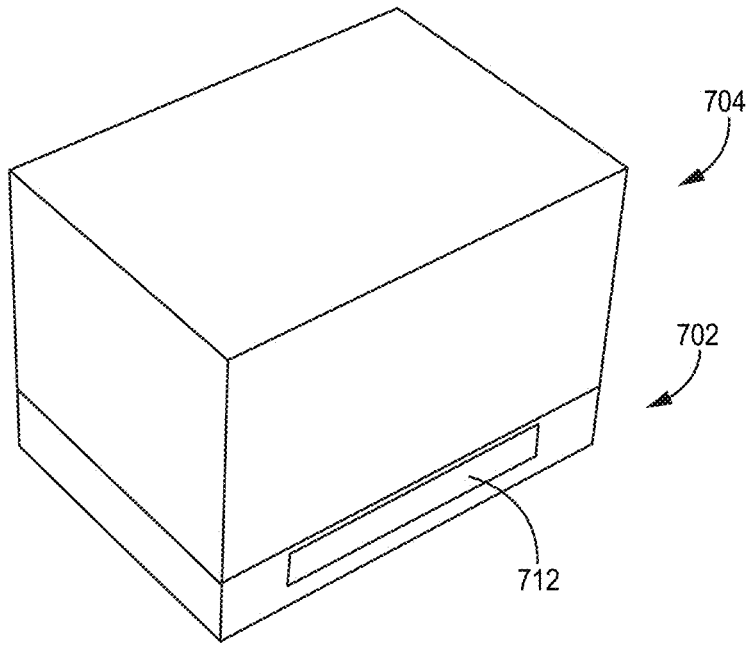
FIGS. 7A-7D are perspective views of an example horizontal evaporator module that can be included in the appliance of FIGS. 1 and 3.
Figure 7B:
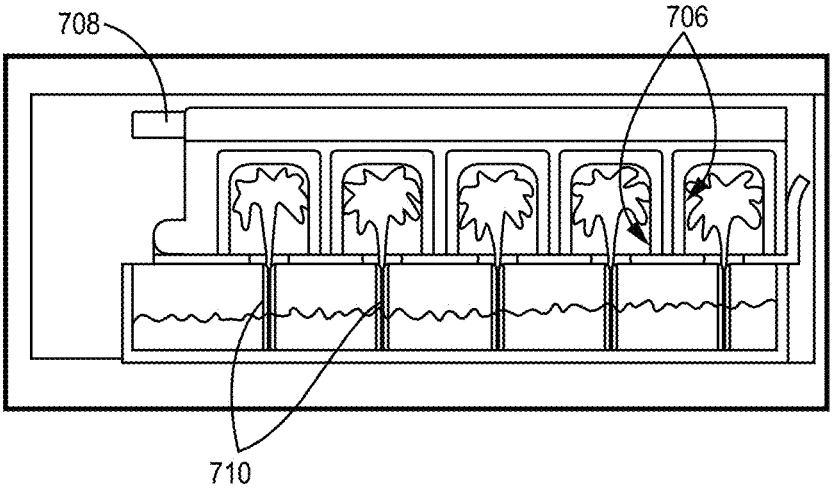

As shown in FIG. 7B, the horizontal evaporator 702 includes a plurality of wells 706 that are disposed to open downward. The cooling line 708 of the evaporator 700 is disposed above the plurality of wells 706 remove heat from water in the wells 706. A respective spray nozzle 710 is configured to spray water from below the wells 706 upward into the wells 706. Water is continually or periodically sprayed into the wells 706 while refrigerant is flowed through the cooling line 708. This cools the wells 706 while water is incident on the surface of the wells 706, causing a portion of the water sprayed up into the wells 706 to freeze on the surface of the wells 706. Over time the frozen water builds on the surface of the wells 706 from the top down. This creates a piece of clear ice in each well, because the ice has frozen in one direction. The plurality of wells 706 can have any desired geometry such as a cube or rectangular prism, thereby forming clear ice having that geometry. To remove the completed pieces of ice from the wells 706, the wells 706 can be slightly warmed, for example, by simply stopping the flow of refrigerant through the evaporator or by flowing warmer refrigerant through the evaporator 702. This warming of the wells 706 can cause the pieces of ice in the wells 706 to release from the wells 706. Other means for ejecting the ice from the wells 706 can also be used.

Figure 7C:
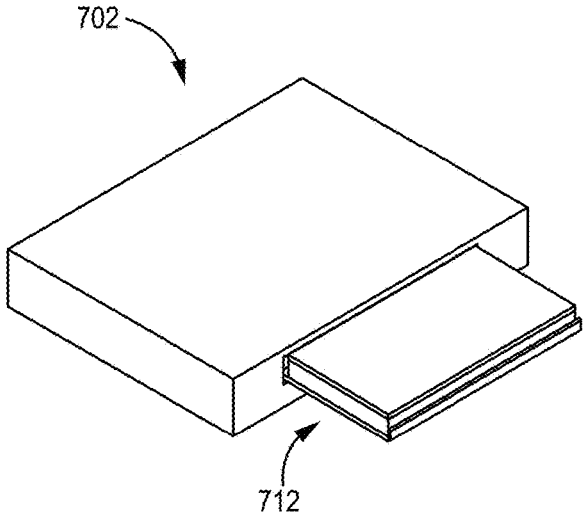
Figure 7D:
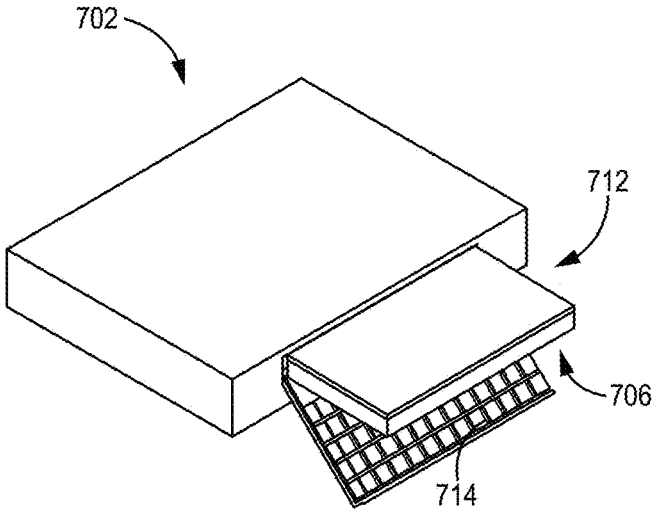

Referring back to FIG. 7A and to FIGS. 7C and 7D, the plurality of wells 706 are disposed on a drawer 712, such that the plurality of wells 706 can be pulled out from their housing in the appliance 100, 300. A tray 714 is disposed beneath the plurality of wells 706 to catch the ice from the wells 706 when the pieces of ice are released from the wells 706. In an example, the tray 714 can be a mesh having apertures therein. There can be an aperture below each well 706 that allows water to be sprayed therethrough into the wells 706 to freeze to the surfaces of the wells 706 as described above. The apertures can have a smaller dimension than the cross section of the wells 706 such that when the pieces of ice are completed they do not fall through the apertures and thus are caught by the tray 714. The tray 714 is hinged on one side allowing it to be pivoted away from the wells 706 when the drawer 712 is pulled out. When the tray 714 is pivoted away from the wells 706, the pieces of ice that have fallen out of the wells 706 are disposed on the tray 714 and can be removed by hand for use. The tray 714 can be pivoted back up against the wells 706 and the drawer 712 closed to make new ice pieces in the wells 706. Although FIG. 7A illustrates the horizontal evaporator 702 disposed below the waterfall evaporator module 102 and the auger evaporator module 104, the horizontal evaporator module 702 can be disposed in any location in which the drawer 712 can be extended and in which the module 702 can be coupled to the refrigeration system 600. Although a certain number and type of evaporator modules are described with respect to the modular component of FIGS. 7A-7D, any number and type of evaporator modules can be included.

Figure 8A:
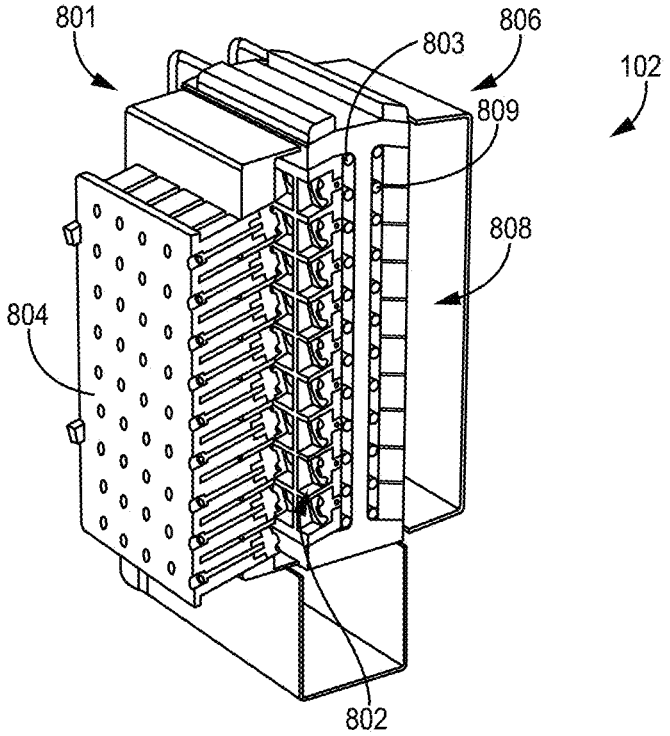
FIG. 8A is a cut-away perspective view of an example waterfall evaporator module for use in the appliance of FIGS. 1 and 3.

FIG. 8A is a cut-away perspective view of an example waterfall evaporator module 102 for use in the appliance 100, 300. The waterfall module 102 includes a first waterfall evaporator 801 which includes plurality of wells 802 disposed in a generally vertical orientation. A cooling line 803 through which refrigerant flows is disposed on the backside of the plurality of wells 802 to remove heat from the wells 802 and the water flowing across the wells 802. To form ice in the wells 802, water is poured onto the wells 802 from the top, such that the water flows over the wells 802 from the top to the bottom of the plurality of wells 802. As the water is flowing over the wells 802, the cooling line on the backside of the wells 802 removes heat from the wells 802 and the water, thereby forming ice in the wells 802. Over time the ice builds up in the wells 802 to form ice pieces. This creates a piece of hard (not chewable) ice in each well. The plurality of wells 802 can have any desired geometry such as a cube or rectangular prism, thereby forming ice pieces having the same geometry. To remove the completed pieces of ice from the wells 802, the wells 802 can be slightly warmed, for example, by simply stopping the flow of refrigerant through the evaporator or by flowing warmer refrigerant through the evaporator. This warming of the wells 802 can cause the pieces of ice in the wells 802 to release from the wells 802. The wells 802 can be oriented slightly downward, such that ice released from a well will slide out of the well and fall away from the waterfall module 102 via the force of gravity. Other means of ejecting the ice from the wells 802 can also be used. The ice pieces falling from the wells 802 of the waterfall module 102 can be directed into an appropriate bin as discussed above with respect to FIGS. 1-4. A screen can be disposed below the wells 802 to allow water flowing across the wells 802 to flow therethrough and collect in a trough below the screen, while directing ice away from the trough toward the appropriate bin. Water in the trough can be reused by recirculating the water to the top of the plurality of wells 802. The screen can also act to reduce a length of the drop from the module 102 to a bin, thus reducing breakage of ice from the module 102.

Figure 8B:
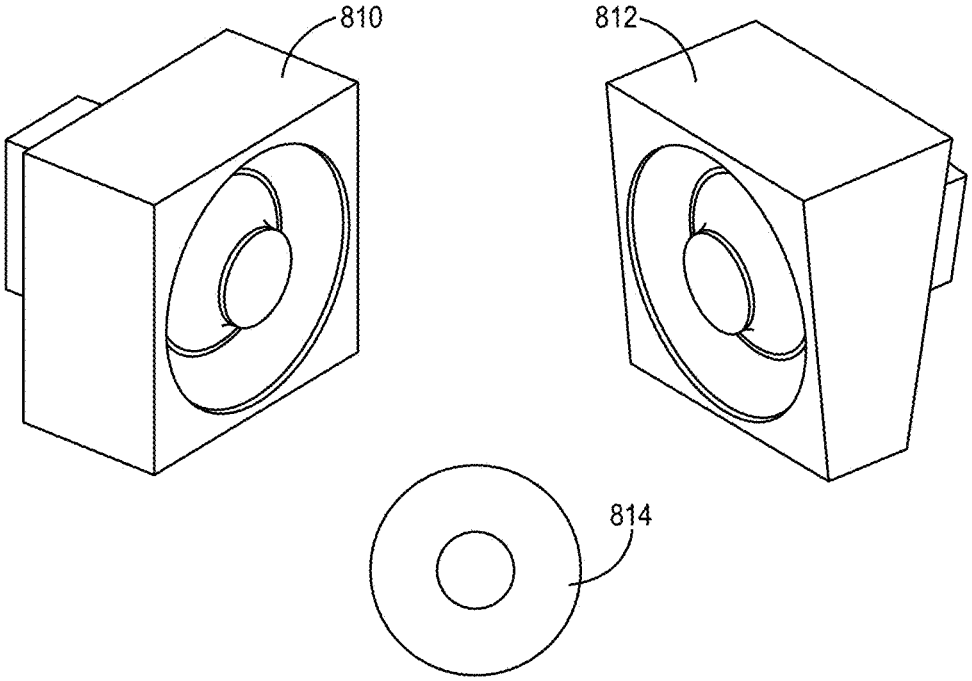
FIG. 8B is a perspective view of an example mold for the waterfall evaporator module of FIG. 8A and an example piece of ice formed by the waterfall evaporator module of FIG. 8A.

In the example shown in FIG. 8A, the waterfall module 102 includes a press plate 804 for shaping the side of the ice pieces in the waterfall module 102 that faces out of the wells 802. The press plate 804 along with the wells 802 form two portions of a plurality of molds that form ice pieces having the geometry of the mold. FIG. 8B is a perspective view of the two portions 810, 812 of a mold and an example piece of ice 814 formed by the mold. One mold corresponds to one well of the plurality of wells. That is, one portion of each mold is formed by the wells 802 and the other portion of each mold is formed by the press plate 804. When the two portions of the molds are brought into contact with one another they assemble into a complete mold that forms both the exposed side of ice in the well as well as the internal side of the ice in the well into a desired geometry. The press plate 804 is configured to move relative to the plurality of wells 802 such that the press plate 804 can be brought towards and away from the wells 802. In operation, the water can be flowed over the plurality of wells 802 as discussed above to form ice in the wells 802. Once the ice in the wells 802 reaches a desired size, the water flow across the wells 802 can be stopped. Then, the press plate 804 can be brought towards the wells 802 such that the portion of the molds on the press plate 804 is brought into contact with the ice pieces in the wells 802. The press plate 804 can be pressed inward, pressing the molds on the press plate 804 against the ice pieces. Any suitable mechanism can be used to move the press plate 804 toward and away from the wells 802.

The press plate 804 can have a temperature warmer than the ice pieces, such that pressure from the press plate 804 on the ice pieces slightly melts the exposed surface of the ice pieces forming the exposed surface into the geometry defined by the mold. The press plate 804 can be maintained at a temperature warmer than the ice pieces by ensuring the press plate 804 is not thermally coupled to the cooling line of the evaporator or by actively heating the press plate 804 to a desired temperature. The press plate 804 can press against the ice pieces until the portions of the mold on the press plate meet the portions of the mold in the wells 802. Once the two press plates meet (e.g., come into contact with one another), the resulting ice piece within the assembled mold will have a geometry defined by the mold. Once the desired geometry of ice is created, the press plate 804 can be moved outward away from the ice pieces and the ice in the wells 802 can be released by warming the wells 802. In this manner, ice having a desired geometry can be formed via the waterfall module 102. Many desired geometries of ice pieces can be formed in such a waterfall module 102, including annular and spherical geometries.

In an example, the portions of the molds in the press plate 804 are removably attached to the press plate 804 and the portions of the molds in the wells 802 are removably attached to the wells 802 enabling the molds to the replaced with different molds having different geometries. The portions of the molds can be manually removable, such as by removing a bolt holding the portion of the mold in place. Each portion of a mold can be individually removable or can be removed as a set of multiple portions of a mold, such as each row being removable as a set. In an example, the press plate 804 itself can be removable as a single unit and/or the plurality of wells 802 can be removable as a single unit. In such an example, the press plate 804 and/or plurality of wells 802 can be replaced with a different composite unit having different molds therein, or the press plate 804 and/or plurality of wells 802 can be removed as a unit and then the portions of the molds can be removed from the press plate 804/plurality of wells 802 after which the press plate 804/plurality of wells 802 with the new molds thereon can be reinstalled into the waterfall module 102. In this way, the geometry of ice formed by the waterfall module 102 can be changed and/or different wells in the module 102 can be set to have different geometries, such that the plurality of wells 802 produces different geometries of ice at the same time.

The example waterfall module 102 includes a second waterfall evaporator 806 that is reverse of the first waterfall evaporator 801. The second waterfall evaporator 806 can be similar to the first waterfall evaporator 801. In particular, the second waterfall evaporator 806 can have a second plurality of wells 808 disposed vertically and a second cooling line 809 disposed on a backside of the second plurality of wells 808. The second plurality of wells 808 and second cooling line 809 can be configured and operate in the same manner as the wells 802 and cooling line 803 for the first waterfall evaporator 801. The cooling line 809 and water for the wells 808 for the second waterfall evaporator 806 can be fluidly coupled in parallel with their counterparts in the first waterfall evaporator 801, such that each evaporator 801, 806 can be controlled individually. The second waterfall evaporator 806 can share a wall with the first waterfall evaporator 801 such that the cooling lines of each waterfall evaporator 801, 806 abut a common wall.

The wells 808 of the second waterfall evaporator 806 can define a different geometry for the ice pieces as compared to the wells 802 of the first waterfall evaporator 801. In an example, the second waterfall evaporator 806 does not include a press plate and, instead, creates cube ice that is not shaped by a press plate on the exposed side. In such an example, the second waterfall evaporator 806 can create ice having a cube geometry whereas the first waterfall evaporator can create ice having a donut or other geometry defined by the molds. In an alternative example, the second waterfall evaporator 806 includes a press plate and interchangeable molds as discussed with respect to the first waterfall evaporator 806. In such an alternative example, the second waterfall module 806 is configured to create ice geometries via molds as discussed above. The molds can be removed and replaced in any of the manners discussed above with respect to the first evaporator 801.

Figure 9A:
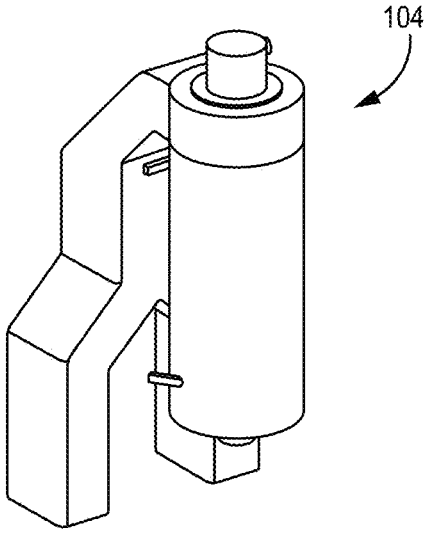
FIG. 9A is a perspective view and FIG. 9B is a cross-sectional perspective view of an example auger evaporator module for use in the appliance of FIGS. 1 and 3.
Figure 9B:
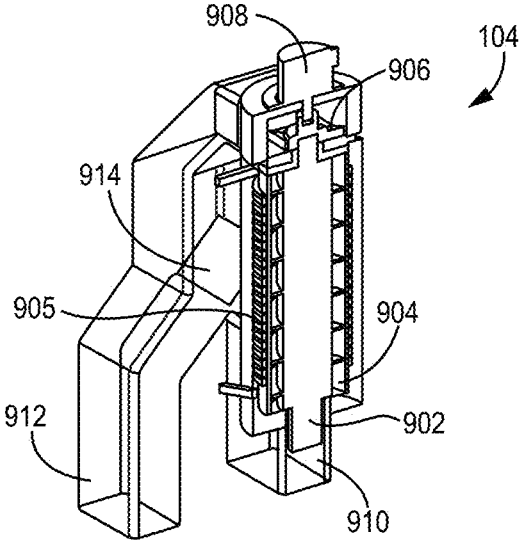

FIG. 9A is a perspective view and FIG. 9B is a cross-sectional perspective view of an example auger evaporator module 104. The auger evaporator module 104 includes an auger 902 disposed in a cylindrical housing 904. The bottom portion of the cylindrical housing 904 is filled with water, forming a pool of water in the housing 904. The auger 902 rotates with respect to the cylindrical housing 904 to push the water upward in the housing 904. A cooling line 905 is disposed around the housing 904 to cool the water in the housing 904. As the water is raised out of the pool in the bottom of the housing 904 the water cools and begins to freeze. The auger 902 continues to push the water upward in the housing 904 as the water freezes. Once the water reaches the top of the housing 904 it is extruded out through one or more apertures defined in the top of the housing 904. A cutter 906 cuts off the frozen water extruded out through the apertures to form pieces of chewable ice. A motor (not shown) is mechanically coupled to the auger 902 and configured to rotate the auger 902 in the housing 904. A second motor 908 is mechanically coupled to the cutter 906 to move the cutter 906 across the one or more apertures to cut the extruded frozen water into pieces.

Figure 10:
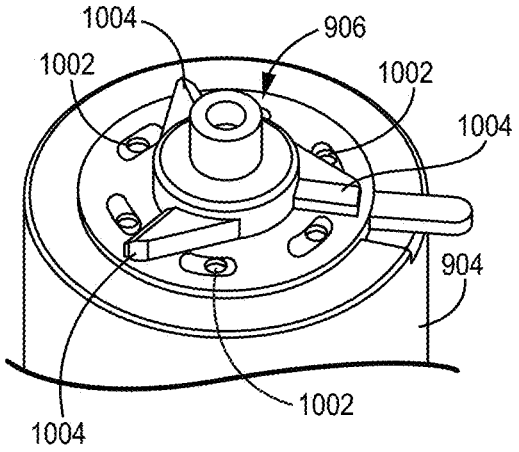
FIG. 10 is a perspective view of the top of the auger module of FIG. 9A showing the cutter and a plurality of apertures in the top of the housing.

FIG. 10 is a perspective view of the top of the auger module 104 showing the cutter 906 and a plurality of apertures 1002 in the top of the housing 904. As described above, frozen water can be extruded out of the apertures 1002 by the auger 902. The cutter 906 has one or more arms 1004 that move across the apertures 1002 to cut the extruded ice off into pieces. In an example, a controller can be coupled to the motor 908 for the cutter 906 and configured to control the frequency in which the cutter 906 moves across the apertures 1002. This affects the size of the ice pieces formed. If the cutter 906 is set to move across the apertures 1002 at a higher frequency, smaller pieces of ice will be formed. If the cutter 906 is set to move across the apertures 1002 at a lower frequency, larger pieces of ice will be formed. In an example, the motor 908 is configured to continually rotate the cutter 906 in a circle to pass the arms of the cutter 906 across the apertures 1002. The frequency in which the arms pass across the apertures 1002 can be adjusted by increasing or decreasing the rate of rotation of the cutter 906. Although FIG. 10 shows a cutter 906 with three arms 1004 and housing top with 6 apertures, any number of arms and apertures can be used.

Figure 11A:
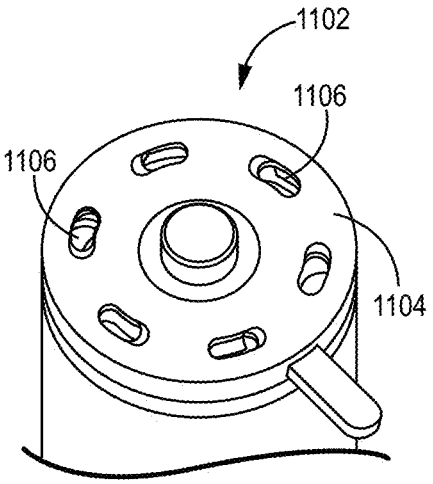
FIGS. 11A and 11B are perspective views of an adjustable die head that can be disposed on the top of the housing of the auger module of FIG. 9A.
Figure 11B:
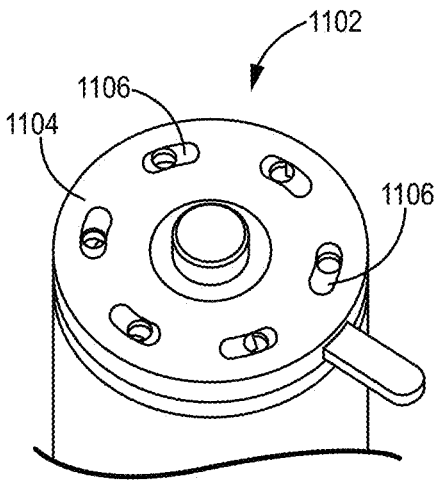

FIGS. 11A and 11B are perspective views of an adjustable die head 1102 that can be disposed on the top of the housing 904. The adjustable die head 1102 includes a plate 1104 having a second plurality of apertures 1106 that can be selectively aligned with the apertures 1002 in the top of the housing 904. The plate 1104 of the adjustable die head 1102 can be rotated with respect to the top of the housing 904, which is fixed, to alter the alignment of the apertures 1106 in the die head 1102 with the apertures 1002 in the top of the housing 904. The apertures 1002 in the top of the housing 904 combine with the apertures in the die head 1102 to form composite apertures through which the frozen water within the housing 904 is extruded. Moving the adjustable plate 1102 changes the lateral size of the composite apertures, thereby changing a width of the ice that is extruded. As used in this section, "lateral" refers to a dimension that is perpendicular to the axis of rotation of the auger 902.

An actuator (not shown) can be mechanically coupled to the die head 1102 to rotate the die head 1102 relative to the top of the housing 904. The controller that controls the motor 908 of the cutter 906 can also control the actuator to adjust the position of the die head 1102. By moving the die head 1102 to a position where the apertures therein are more aligned with the apertures 1002 in the top of the housing 904, ice pieces having a larger width can be created. By moving the die head 1102 to a position where the apertures 1106 of the movable plate 1104 are less aligned with the apertures 1002 in the top of the housing 904, ice pieces having a smaller width can be created. Because changing the alignment of the apertures also changes the cross-sectional shape of the composite apertures, adjusting the die head 1102 also changes the cross-sectional shape of the ice pieces created. Thus, adjusting the die head 1102 can also adjust the cross-sectional shape of ice pieces created from, for example, a more rectangular cross-section to a more circular cross-section. The controller can control the die head 1102 along with the motor 908 of the cutter 906 to adjust the length of ice pieces created by the auger module 102. As discussed above, although a certain number and size of apertures 1002 in the top of housing 904 and in the die head 1102 are shown, any number, size and/or shape of aperture can be used.

Referring back to FIGS. 9A and 9B, the controller that is communicatively coupled to the motor for the cutter 906 and the actuator for the die head 1102 can also be communicatively coupled to the motor for the auger 902. The controller can thus control the motor for the auger 902 to adjust the rotation rate of the auger 902. Rotating the auger 902 faster reduces the time that water spends moving from the pool on the bottom of the housing 904 to the apertures 1002 on the top of the housing. This reduces the amount of time that the water has to freeze in the housing, which results in softer ice being extruded through the apertures 1002 and, softer ice pieces created by the auger module 102. Rotating the auger 902 slower increases the time that water spends traversing the to the apertures 1002 and creates harder pieces of ice. Thus, the controller can control the rate of rotation of the auger 902 to adjust the hardness of ice pieces created by the auger module 102.

In an alternative example, the housing 904 can be disposed in a non-vertical orientation (e.g., horizontal or angled) with one or more respective apertures on a first end thereof. In one embodiment of such an alternative example, the housing 904 can have one or more apertures on both ends. In either case, the aperture(s) on the end(s) of the housing 904 can be disposed for ice formed in the housing to be extruded therethrough. The aperture(s) can be disposed above a level of water in the housing to hold the water in the housing while allowing ice formed from the water to be extruded through the aperture(s). In examples having aperture(s) on both ends, the aperture(s) on a first end of the housing 904 can have a first size and/or shape and the aperture(s) on the opposite end of the housing 904 can have a second size and/or shape. The motor powering the auger 902 can be configured to rotate the auger in both directions such that ice formed in the housing 904 can be extruded through the aperture(s) in the first end of the housing 904 when the auger 902 is rotated in a first direction and can be extruded through the aperture(s) in the second end of the housing 904 when the auger 902 is rotated in a second direction. In other examples, the housing 904 can have aperture(s) only on the first end. In any case, the auger 904 can include an adjustable die head on one or both ends thereof, and a cutter on each end that is rotated by a motor as described above.

Overall, the auger module 102 provides a dynamically adjustable means of making chewable ice in the appliance 100, 300. For example, the controller can control the auger 102, cutter 906 and/or die head 1102 to dynamically modify the characteristics of ice created by the auger module 102. Advantageously, these adjustments can be made without the user having to mechanically change any parts. The adjustments can be made electronically via control of the components of the auger module 102 as discussed above. Accordingly, the auger module 102 can be configure to create first ice pieces having a first set of characteristics at a first time and second ice pieces having a second set of characteristics at a second time. The auger module 102 can be configured to direct the first ice pieces into a first bin and to direct the second ice pieces into a second bin, such that ice with different characteristics is stored and can be accessed separately. In an example, the auger module 102 can include a plurality of chutes 910, 912 that direct ice pieces formed by the auger module 102 to respective bins of the appliance 100, 300.

In the example shown in FIGS. 9A and 9B, the auger module 102 includes two chutes 910, 912, however other numbers of chutes can be included. The chutes 910, 912 can be disposed such that ice pieces cut off by the cutter 906 fall from the top of the housing 904 into the chutes 910, 912. The chutes 910, 912 then direct the falling ice pieces into respective bins of the appliance 100, 300. A movable flap 914 can be configured to direct the ice pieces falling from the top of the housing 904 into either the first chute 910 or the second chute 912. An actuator that moves the flap 914 into a first position to direct ice pieces into the first chute 910 or a second position to direct ice pieces in to the second chute 912 can be communicatively coupled to the controller, such that when first ice having first characteristics is created, the flap 914 can be set to the first position to direct the first ice into a first bin and when second ice having second characteristics is created, the flap 914 can be set to the second position to direct the second ice into a second bin.

In an example, the appliance 100, 300 discussed herein is configured to create ice having characteristics that are provided by a user. These characteristics can be provided from user selections at a human machine interface (HMI) on the appliance 100, 300 or from information from a separate computing device (e.g., mobile phone with appliance app). The user can select from a set of available options provided by the HMI to instruct the appliance 100, 300 as to which type of ice to create. In response to receiving a selection, the appliance 100, 300 can create ice having the selected characteristics and store the ice in a bin for use.

In an example, the HMI can provide a first option of flake ice. Upon receiving a selection of flake ice from a user at the HMI, the controller in the appliance 100, 300 can control the auger module 104 such that it creates flake ice and directs the flake ice into a first bin. To make flake ice, for example, the auger 902 can be set to a comparatively slow rate of rotation, and the cutter 906 can be set to a comparatively high frequency of cutting, such that the ice extruded by the auger module 102 is comparatively hard and is sliced comparatively thin creating flakes of ice.

The HMI can also provide a second option of small chewable nugget ice. Upon receiving a selection of small chewable nugget ice from a user at the HMI, the controller can control the auger module 104 to create small chewable nugget ice. To make such small chewable nugget ice, for example, the auger 902 can be set to a comparatively higher rate of rotation and the cutter 906 can be set to a medium frequency of cutting. The die head 1102 can be set to provide a small composite aperture. The ice created by the auger module 104 with such settings is comparatively soft and small.

The HMI can also provide a third option of large rectangular nugget ice. Upon receiving a selection of large rectangular nugget ice from a user at the HMI, the controller can control the auger module 104 to create large rectangular nugget ice. To make such large rectangular nugget ice, for example, the auger 902 can be set to a comparatively lower rate of rotation and the cutter 906 can be set to a low frequency of cutting. The die head 1102 can be set to provide a large composite aperture having a rectangular cross-section. The ice created by the auger module 104 with such settings is comparatively soft and small.

Another option provided by the HMI can be non-chewable cube ice. Upon receiving a selection of non-chewable cube ice from a user at the HMI, the controller can control the waterfall module 102 to create non-chewable cube ice. To make such non-chewable cube ice, for example, the controller can cause the second evaporator 806 (without a press plate) of the waterfall module 102 to make ice. The ice made by this second evaporator 806 is non-chewable cube ice, which can be directed to an appropriate bin in the appliance 100, 300.

Still another option provided by the HMI can be donut shaped ice. Upon receiving a selection of donut shaped ice from a user at the HMI, the controller can control the waterfall module 102 to create donut shaped ice. To make such donut shaped ice, for example, the controller can cause the first evaporator 801 with a press plate and donut shaped molds to make ice. This ice will have a donut shape and can be directed to an appropriate bin in the appliance 100, 300.

In an example, the appliance 100, 300 can be configured to swap out the molds in the first evaporator 801 and/or second evaporator 806 in response to a selection of ice from a user. For example, the HMI can provide multiple different shapes of ice for selection by a user, and the appliance 100, 300 can include a set of molds for the first evaporator 801 corresponding to each shape of ice that can be selected. In response to receiving a selection of a particular shape of ice (e.g., star shaped) the appliance 100, 300 can swap the molds in the first evaporator 801 such that the first evaporator 801 includes the star shaped ice molds. The swap can replace the molds via replacement of the press plate and plurality of wells, or via swapping of individual molds in the press plate and plurality of wells as described above with respect to the first evaporator 801.

The ice selection options provided by the HMI can be provided in any suitable manner. For example, the selections can be via manual buttons on the face of the appliance 100, 300. Alternatively, the HMI can include a touch screen with a user interface that is configured to receive selections of a type of ice. In another example, the HMI can be implemented via a mobile app that can be installed on a personal mobile device and is communicatively coupled (e.g., via Bluetooth or a wireless network) to the controller of the appliance 100, 300. Furthermore, the selection provide can be specific selections of particular kinds of ice (e.g., donut shaped, flake, small chewable nugget) and/or can allow the user to select values (e.g., numerical values or sliding scales) of specific characteristics of the ice (e.g., geometry, volume, compressive strength, clarity, etc.). In any case, the controller receives the selections from a user and controls the evaporator modules 102, 104 of the appliance 100, 300 to create the desired ice.

The controller(s) of the appliance 100, 300 can include one or more processing devices for executing computer readable instructions, which may include a microprocessor. The instructions are configured to implement the controlling as described herein. The instructions can be stored (or otherwise embodied) on or in an appropriate storage medium or media (such as a hard drive or other non-volatile storage) from which the instructions are readable by the processing device(s) for execution thereby. The one or more processing devices can be coupled to the storage medium or media to access the instructions therefrom. The instructions can, when executed by the processing device(s), cause the controller to perform the actions described herein. The controller can include memory coupled to the processing device(s) for storing instructions (and related data) during execution by the processing device(s). Memory can comprise any suitable form of random-access memory (RAM) now known or later developed, such as dynamic random-access memory (DRAM), and may comprise other types of suitable memory. The controller also includes at least one communication interface (e.g., an ethernet port, a wi-fi transceiver, or a Bluetooth transceiver) for communicatively coupling to external device(s).

The controller's instructions or a portion thereof can be stored or otherwise embodied on a computer readable medium that is distinct from any device and can be loaded onto a controller. The computer readable media on which the instructions are stored can be any suitable computer readable media such as magnetic media (e.g., a hard disk drive), optical media (e.g., a CD, DVD or Blu-Ray disk) or a non-volatile electric media (e.g., a solid-state drive, flash media, or EEPROM). By way of the communication interface, the controller can communicate with an external device such as a mobile phone or personal computer. A user on an external device can remotely control or otherwise command the controller, for example, via selection of ice to create as discussed above.

The controller can implement the actions described herein by, inter alia, opening or closing the fill solenoid(s) 620-622 and warm refrigerant solenoids 652, 653 for each evaporator 816-818, and controlling the condenser 604 and compressor 602. To perform its ice making control functions, the controller may receive input from one or more sensors, such as one or more temperature sensors disposed through the appliance and/or one or more sensors to sense a level of ice in respective bins. In response to a signal from a sensor indicating that the level of ice in a bin has dropped below a threshold, the controller can cause an evaporator module that makes the type of ice assigned to the bin to make more ice. The controller can also increase or decrease the production of one or more types of ice based on other factors, such as time. For example, the controller can increase ice production prior to the evening, such that more ice is available during the evening period when more ice is consumed. In an example, the level of ice maintained in one or more of the bins by the controller can vary based on time. For example, from the hours of 1 am to 6 am, the level of ice maintained in the bins can be as low as possible (a lowest threshold), from 6 am to 4 pm a medium threshold can be used, and from 4 pm to 1 am a high threshold can be used. The controller can also control the amount of ice that is dispensed at a time, such a small, medium, or large amount. This control of ice dispensed can be performed by adjusting how long and/or fast and auger is rotated to move ice from a bin to be dispensed. The control can be based on a type of ice that is disposed in a bin, e.g., the auger runs longer and/or slower for larger cube ice and faster and/or shorter time period for nugget ice. The control can also be based on user selection of amount to dispense.

Referring back to FIG. 1, the appliance 100, 300 can include adjustable bins 106-109. The adjustable bins 106-109 can adjust a volume (i.e., capacity) of one or more of the bins 106-109, such that a configurable amount of a particular type of ice can be made and stored. The volume of the bins 106-109 can be adjustable in any suitable manner, including via movable dividers between the bins 106-109. For example, four bins 106-109 can be included in the appliance 100, 300 as shown in FIG. 1, and the appliance 100, 300 can be configured to direct ice from the first evaporator 801 into the first bin 106, ice from the second evaporator 806 into the second bin 107, first ice from the auger module 104 to the third bin 108, and second ice from the auger module 104 to the fourth bin 109. The HMI can be configured to receive a selection indicating how much of four types of ice to create. The selection can be received in any suitable format, such as percentages (10/40/25/25) or relative amounts (large, medium, small). For example, the selection can indicate that 10 percent of the ice be a specific geometry of non-chewable ice (e.g., donut shaped), 40 percent of the ice be a different geometry of non-chewable ice (e.g., cube), 25 percent of the ice be chewable nugget ice, and 25 percent of the ice be flake ice. In response to such a selection, the controller can adjust the volume of the first bin 106 and the second bin 107 (e.g., via a movable divider), such that the first bin 106 is smaller than the second bin 107 and corresponds to the amount of ice selected. In other examples, the volume of one or more of the bins 106-109 is manually configurable, such as via insertable or movable dividers.

Referring now to FIG. 4, in other examples, the appliance 100, 300 can include more bins 402-409 than evaporator modules 102, 104 and can include one or more movable flaps (not shown) to direct different types of ice from the same evaporator module into different bins 402-409. The one or movable flaps can be similar to the flap 914 discussed above with respect to the auger module 104. For example, the appliance 100, 300 can be configured to direct ice from the first waterfall evaporator 801 of the evaporator module 102 to a first bin 402 during a first time period and configured to direct ice from the first evaporator module 801 to a second bin 404 during a second time period. The first waterfall evaporator 801 can be configured with a first mold to make a first geometry of ice during the first time period and a second mold to make a second geometry of ice during the second time period. In this way, the appliance 100, 300 can make different types of ice with a common evaporator and store the different types of ice in separate bins. In an example, different bins can have different volumes, such that in response to user selection of an amount of a particular type of ice to make, the controller is configured to control the flaps to store the ice in a bin corresponding to the amount of ice selected. For example, if the HMI receives a selection indicating a large amount of cube ice, the controller can be configured to direct ice from the second waterfall evaporator 806 to the fourth bin 405, which is large. In some examples, the volume of one or more of the bins 402-409 is manually configurable, such as via insertable or movable dividers.

What is claimed is:

1. An apparatus for making ice, the apparatus comprising:

a refrigeration system configured to provide chilled coolant to two or more evaporators, the two or more evaporators configured to produce ice having a first set of characteristics and to produce ice having a second set of characteristics, wherein the characteristics of the first set of characteristics and the characteristics of the second set of characteristics consist of geometry, volume, compressive strength, and clarity, wherein at least one characteristic of the second set of characteristics is different in value than the corresponding characteristic in the first set of characteristics.

2. The apparatus of claim 1, wherein the two or more evaporators include a waterfall evaporator and an auger evaporator.

3. The apparatus of claim 2, wherein the ice having the first set of characteristics is non-chewable ice and the ice having the second set of characteristics is chewable ice.

4. The apparatus of claim 1, comprising:

a first bin disposed to collect the ice having the first set of characteristics; and a second bin disposed to collect the ice having the second set of characteristics.

5. The apparatus of claim 4, comprising:

a controller configured to:

control a first evaporator of the two or more evaporators based on an amount of ice in the first bin;

control a second evaporator of the two or more evaporators based on an amount of ice in the second bin; and control the compressor based on demand from the first evaporator and the second evaporator.

6. The apparatus of claim 4, comprising:

a third bin for collecting ice, wherein the two or more evaporators are configured to produce ice having a third set of characteristics, wherein the characteristics of the third set of characteristics consist of geometry, volume, compressive strength, and clarity, wherein at least one characteristic of the third set of characteristics is different in value from at least one corresponding characteristic in the first set of characteristics and the second set of characteristics, wherein the apparatus is configured to:

direct ice having the first set of characteristics to the first bin;

direct ice having the second set of characteristics to the second bin; and direct ice having the third set of characteristics to the third bin.

7. The apparatus of claim 4, comprising:

a human machine interface configured to receive input from a human selecting a type of ice to dispense; and a controller coupled to the human machine interface and configured to dispense ice from the first bin in response to receiving a signal from the human machine interface indicative of a human selecting the first type of ice and to dispense ice from the second bin in response to receiving a signal from the human machine interface indicative of an input received by the human machine interface indicating the second type of ice to dispense.

8. The apparatus of claim 1, comprising:

two or more bins that are adjustable in volume and disposed to collect ice from the two or more evaporators.

9. An apparatus for making ice, the apparatus comprising:

a waterfall evaporator including:

a water outlet for liquid water;

a plurality of wells disposed such that liquid water flows from the water outlet across the plurality of wells;

a cooling line configured to remove heat from the plurality of wells;

a plurality of molds for forming ice of a defined geometry, each of the plurality of molds including a first mold portion and a second mold portion which, when assembled, form a chamber having the defined geometry, the first mold portion of each of the plurality of molds disposed in a respective well of the plurality of wells, the second mold portion of each of the plurality of molds opposing the first mold portion, wherein the second mold portion of each of the plurality of molds is configured to move relative to the first mold portion such that the plurality of molds have an open position and a closed position, in the open position water can flow over the plurality of wells and freeze into a geometry defined by the first mold portion, in the closed position, ice formed on the first mold portion is pressed by the second mold portion to form ice of the defined geometry.

10. The apparatus of claim 9, wherein the first mold portion of each of the plurality of molds is removably connected to its respective well of the plurality of wells and the second mold portion of each of the plurality of molds is removably connected to a press plate such that the plurality of molds can be replaced with a different plurality of molds forming ice of a different defined geometry.

11. The apparatus of claim 10, wherein the press plate is configured to move towards and away from the plurality of wells to dispose the plurality of molds in the open position and the closed position.

12. The apparatus of claim 9, comprising:

a second waterfall evaporator including:

a second water outlet for liquid water;

a second plurality of wells disposed such that liquid water flows from the second water outlet across the second plurality of wells, the second plurality of wells disposed reverse of the plurality of wells, the second plurality of wells configured to produce ice having a different geometry than the defined geometry of the plurality of wells; and a second cooling line configured to remove heat from the second plurality of wells.

13. An apparatus for making ice, the appliance comprising:

an auger evaporator including:

a housing configured to hold water therein, the housing having one or more apertures on a first end thereof;

a cooling line disposed around the housing to remove heat from the housing;

an auger disposed in the housing;

a motor configured to rotate the auger relative to the housing, wherein the auger, when rotated by the motor, moves water toward the first end of the housing, wherein the water freezes as it moves towards the first end and is extruded out of the one or more apertures in the first end; and a cutter disposed on the first end of the housing and configured to move across the one or more apertures to cut off ice extruded through the one or more apertures to form discrete pieces of ice; and a motor configured to move the cutter across the one or more apertures;

a controller configured to control the auger evaporator to:

make first ice during a first time period; and make second ice during a second time period, wherein the second ice is different in at least one characteristic from the first ice.

14. The apparatus of claim 13, wherein the at least one characteristic includes one or more of:

a compressive strength of the ice, a length of the ice, and a cross-sectional shape of the ice.

15. The apparatus of claim 14, wherein control the auger evaporator includes control one or more of the rate of rotation of the auger, the direction of the auger, and the frequency in which the cutter moves across the one or more apertures.

16. The apparatus of claim 13, wherein the motor for the cutter is configured to rotate the cutter in a circle at a defined rate, wherein the controller is configured to increase the rate of rotation to create ice of a shorter length and to decrease the rate of rotation to create ice of a longer length.

17. The apparatus of claim 13, comprising:

an adjustable die head on the first end of the housing, the adjustable die head including a fixed plate and a movable plate adjacent to the fixed plate, wherein the fixed plate defines a first one or more portions of the one or more apertures and the movable plate defines a second one or more portions of the one or more apertures, wherein the movable plate is movable relative to the fixed plate to adjust a lateral size of the one or more apertures; and an actuator configured to move the movable plate relative to the fixed plate to adjust a lateral size of the one or more apertures, wherein control the auger evaporator includes control a position of the movable plate relative to the fixed plate.

18. The apparatus of claim 13, comprising:

a human machine interface configured to receive input from a human selecting one or more characteristics for the first ice and one or more characteristics for the second ice, wherein control the auger evaporator includes make first ice and second ice corresponding to input received by the human machine interface.

19. The apparatus of claim 13, comprising:

a first bin disposed to collect ice from the auger evaporator;

a second bin disposed to collect ice from the auger evaporator;

a flapper movable between a first position and a second position, wherein in the first position the flapper directs ice from the auger evaporator into the first bin and in the second position the flapper directs ice from the auger evaporator into the second bin, wherein the controller is configured to control the flapper to be in the first position during the first time period, and to control the flapper to be in the second position during the second time period.

20. The apparatus of claim 13, wherein the housing defines a second one or more apertures in a second end of the housing opposite of the first end of the housing, wherein the controller is configured to control a direction of rotation of the auger such that water is moved towards a first end of the housing when the auger is rotated in a first direction and moved towards a second end of the housing when the auger is rotated in a second direction opposite the first direction.

* * * * *